US005979090A

United States Patent [19]

Lee et al.

[11] Patent Number: 5,979,090

[45] Date of Patent: Nov. 9, 1999

[54] DESIGN FOR TRIPTYCH CALENDAR AND STAGE

[76] Inventors: Kathleen Lee, 264 Court St., Brooklyn, N.Y. 11231; Martha Fay, 221 W. 82nd St., New York, N.Y. 10024

[21] Appl. No.: 09/055,624

[22] Filed: Apr. 6, 1998

[51] Int. Cl.[6] ..... G09D 3/04; G09D 3/00

[52] U.S. Cl. ..... 40/119; 40/107

[58] Field of Search ..... 40/107, 119, 121, 40/617, 124.09, 124.11, 124.12; 283/2

[56] References Cited

U.S. PATENT DOCUMENTS

| | | | |
|---|---|---|---|
| 1,371,439 | 3/1921 | Radford . | |
| 1,602,583 | 10/1926 | Lawrence | 40/124.09 |
| 1,619,095 | 3/1927 | Usoskin | 40/124.09 |
| 1,875,804 | 9/1932 | Dicicco | 40/124.12 |
| 2,354,589 | 7/1944 | Georgi | 40/119 |
| 2,436,105 | 2/1948 | Fisler | 40/124.09 |
| 2,737,745 | 3/1956 | Hartmann . | |
| 3,091,877 | 6/1963 | Luchsinger | 40/124.09 |
| 3,225,474 | 12/1965 | Dusseau | 40/124.09 |
| 4,024,656 | 5/1977 | Farnsworth | 40/121 |
| 5,280,961 | 1/1994 | Rohloff | 283/2 |
| 5,303,487 | 4/1994 | Olson | 40/124.11 |

*Primary Examiner*—Terry Lee Melius
*Assistant Examiner*—James M. Hewitt
*Attorney, Agent, or Firm*—Gottlieb, Rackman & Reisman, P.C.

[57] ABSTRACT

A triptych construction made from a single cardboard blank is provided. The construction comprises a main display panel having a front face with an image depicted on it. Also provided is a pair of side door panels, each foldably connected to the main panel along opposite side edges. Each side panel is foldably displaceable between a first open outwardly extending position such that the image on the front face of the main panel is fully visible, and a second inwardly extending position for substantially covering up the image on the front face from view.

21 Claims, 5 Drawing Sheets

DESIGN FOR TRIPTYCH CALENDAR AND STAGE

BACKGROUND OF THE INVENTION

This invention relates to a triptych construction, and more particularly, to a triptych construction suitable as a calendar or three-dimensional stage structure.

The invention utilizes the form of a triptych, a configuration of three panels joined together to display multiple scenes. The triptych form became popular during the Middle Ages and was used mainly for religious paintings (which comprised nearly all the art of the period).

Typically, the triptych, which in that period was constructed from wood and then painted, was either hung on the wall or was displayed in a free-standing position, with the opened side panels acting as supports. The free-standing triptych often served as an altar piece, especially in the private chapels of the wealthy art patrons who commissioned such works.

An obvious antecedent of the triptych construction is the wall calendar, which has been used worldwide for at least the last 150 years and which continues to grow in popularity, especially as a specialty, promotional or gift item. Also popular in the 20th Century are foldout or pop-up books, especially those for children (printed on heavy paper stock), "pop-up" greeting cards, and calendars (e.g., Advent calendars), which have little flaps (or "doors") which open to display a picture for each day of a particular time period.

In view of the above, it would be desirable to provide a triptych design for calendars, story books, etc.

SUMMARY OF THE INVENTION

Generally speaking, in accordance with the invention, a novel triptych construction is provided. The construction is made from a cardboard blank and comprises a main display panel having a front face with an image depicted on it, with the panel being defined by a top, a bottom and opposite side edges. Also provided is a pair of side door panels, each foldably connected to the main panel along opposite side edges. Each side panel is foldably displaceable between a first open outwardly extending position such that the image on the front face of the main panel is fully visible, and a second inwardly extending position for substantially covering up the image on the front face from view.

Significantly, there is also provided a series of display pages, together defining a display page booklet, including a topmost page and succeeding underlying pages. Each page has a front face with a unique image depicted on it. The pages foldably depend from the bottom edge of the main display panel such that each page may be selectively folded or flipped to a position overlying the front face of the display panel.

Preferably, the side panels have front faces with images depicted on them that are complementary to the image depicted on the front face of the main panel.

In a preferred form of the inventive construction, a flap panel is provided that is foldably connected to the main panel along the top edge of it. The flap panel has a front face, also with an image depicted on it which is complementary to the image depicted on the front face of the main panel.

In its most preferred form, the display pages of the triptych construction have back faces also with images depicted on them which are viewable when each page is flipped over to overlie the front face of the main panel. Each of the images depicted on the back face of each display page is complementary to the image depicted on the front face of the succeeding display page since these faces will be viewable together.

In one form of the triptych construction, the series of display pages define a calendar. In particular, each front face of the display pages depict a specific calendar month grid, and is removed from viewing as each month passes in time.

For construction purposes, the assembly also includes a lower or depending panel which is foldably connected to the bottom edge of the display panel, and which effectively acts as a back to the series of display pages.

Accordingly, it is an object of the invention to provide an improved triptych construction.

It is another object of the invention to provide a triptych construction that is suitable for use as a display calendar.

Yet another object of the invention is provide a triptych construction made from a single cardboard blank.

A further object of the invention is to provide a triptych construction that may be used as a stage for a live-action children's book.

A further object of the invention is to provide a triptych construction which may be folded into a concise, packaged condition.

Still other objects and advantages of the invention will in part be obvious and will in part be apparent from the following description.

The invention accordingly comprises the article of manufacture possessing the features, properties and relation of elements which will be exemplified in the article hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

Figure 2:
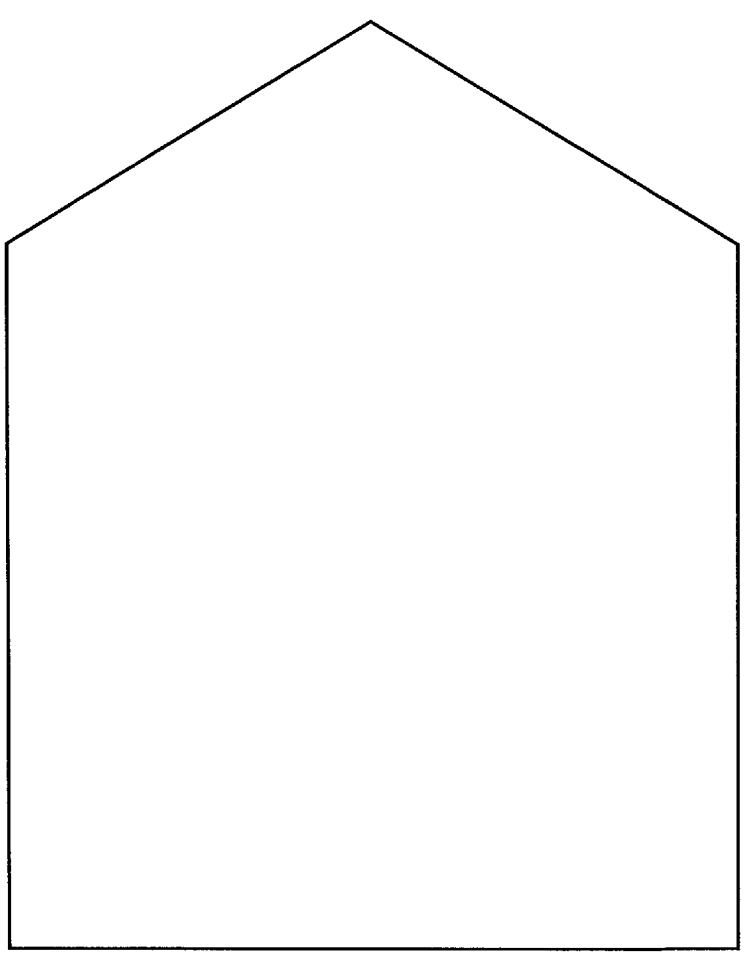
FIG. 2 is a rear elevational view of the triptych construction of the invention.
Figure 1:
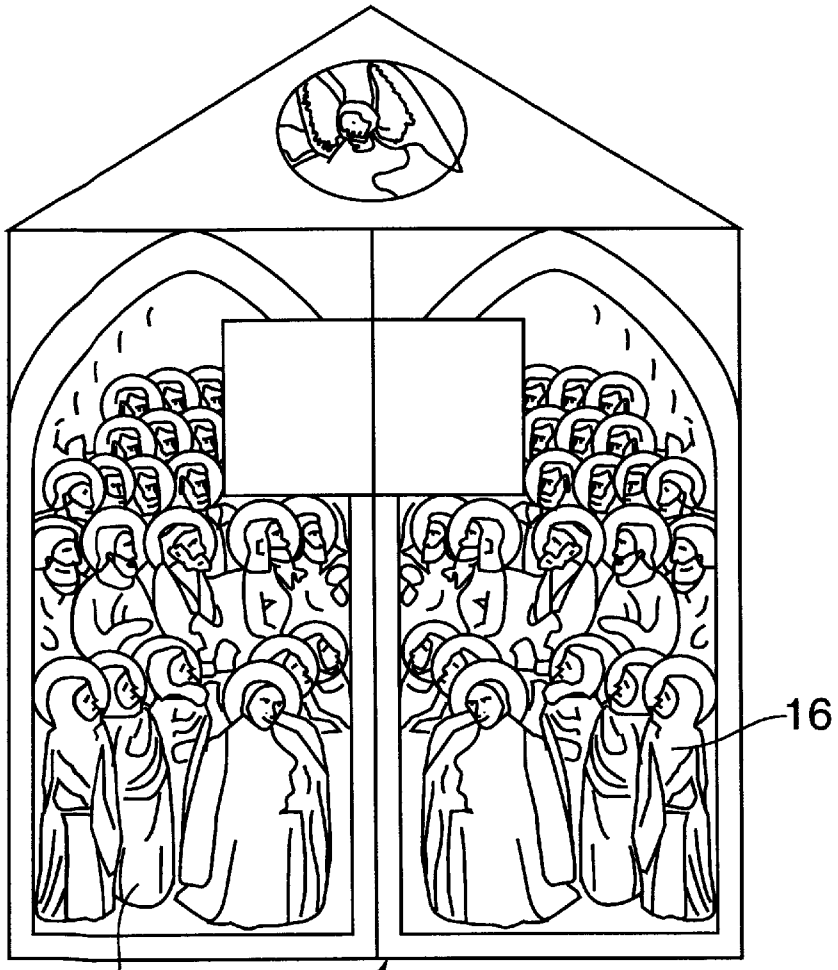
FIG. 1 is a front elevation view of the triptych construction in a folded, packaged condition.
Figure 3:
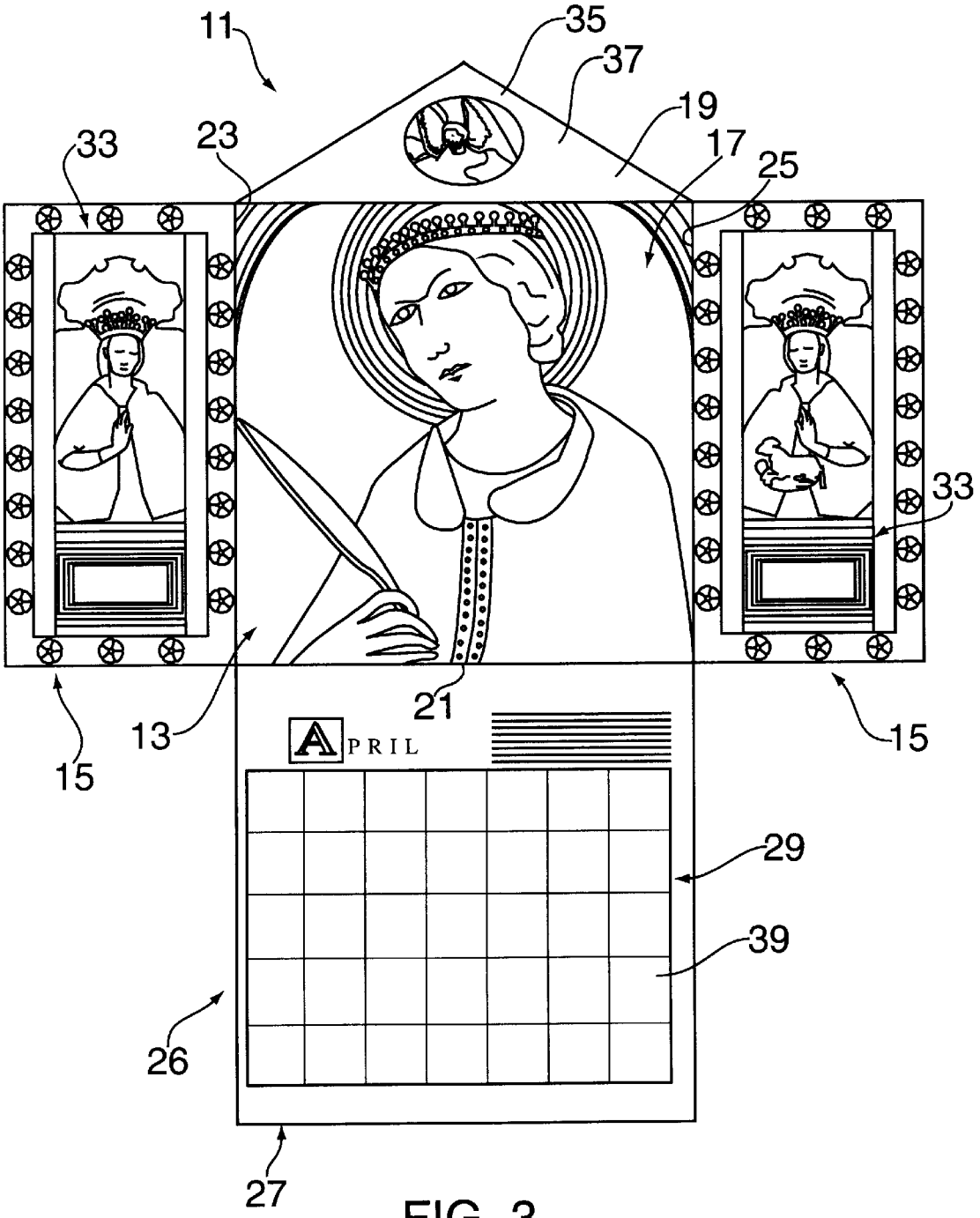
FIG. 3 is a front elevational view showing the triptych construction in an open displayed condition revealing a series of display pages.

Referring first to FIGS. 1 and 3, a triptych construction made in accordance with the invention, and generally indicated at 11, is shown. Triptych construction 11 is made from a paper or paper equivalent blank and includes a main panel 13 and a pair of side door panels 15, foldably connected to main panel 13 along opposite side edges 23 and 25 respectively. Main panel 13 is square or rectangular in configuration and includes a front face 17 with an image depicted thereon. Side panels 15 have front faces 33 with images depicted thereon that are complementary to the image depicted on front face 17 of main panel 13.

Each of side panels 15 is foldable along edges 23 and 25 respectively between a first open outwardly extending position (see FIG. 3) such that the decorative image depicted on front face 17 of main panel 13 is fully visible, and a second inwardly extending position (see FIG. 1) for substantially covering up the image on front face 17 of main panel 13. As shown in FIG. 1, each of side panels 15 also includes back faces 16 with images depicted thereon that are complementary to each other, and which are viewable when construction 11 is in a closed or packaged condition.

Figure 5:
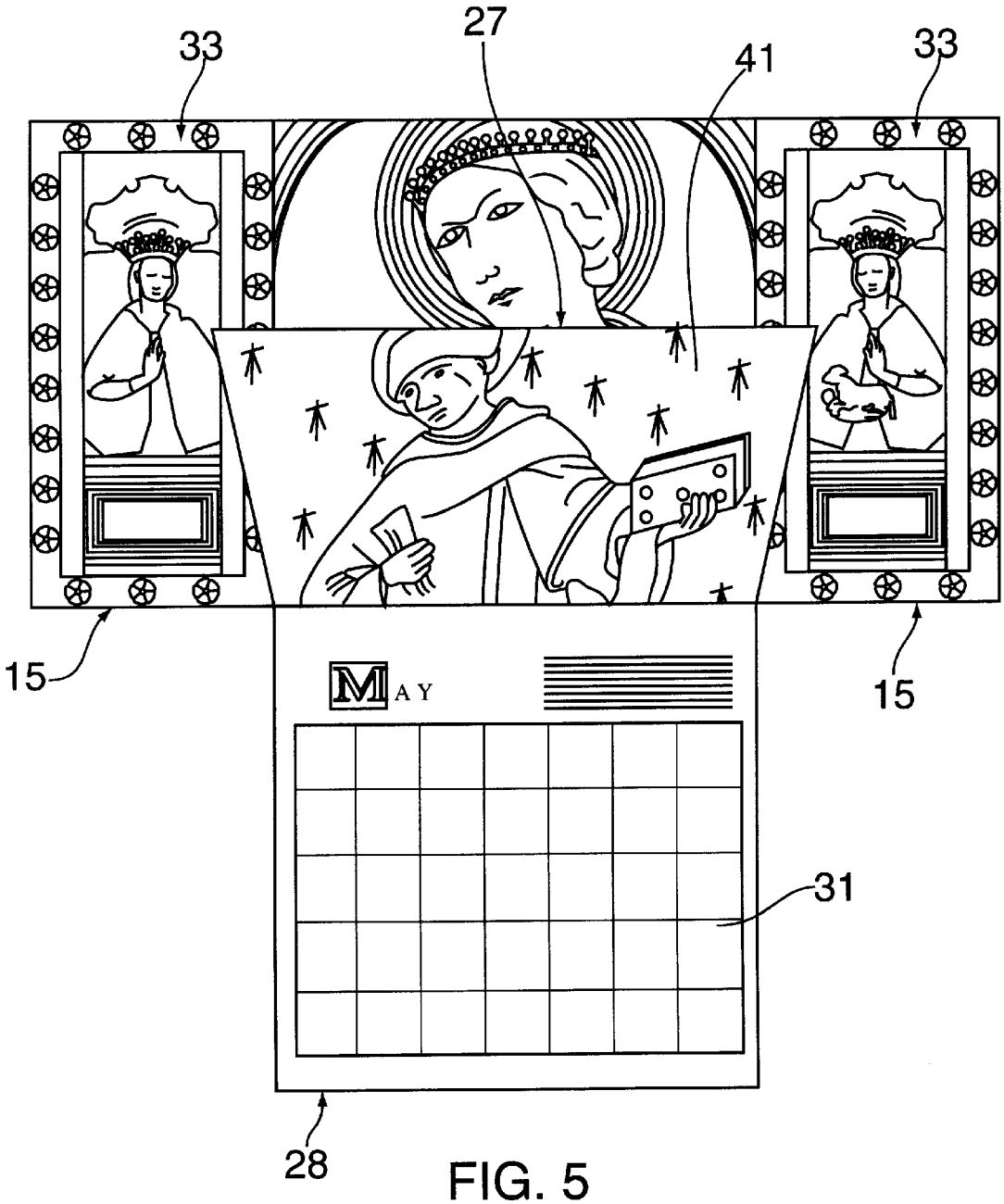
FIG. 5 is a front elevational view illustrating how the topmost page of the series of display pages may be moved or flipped over to reveal the next display page.
Figure 6:
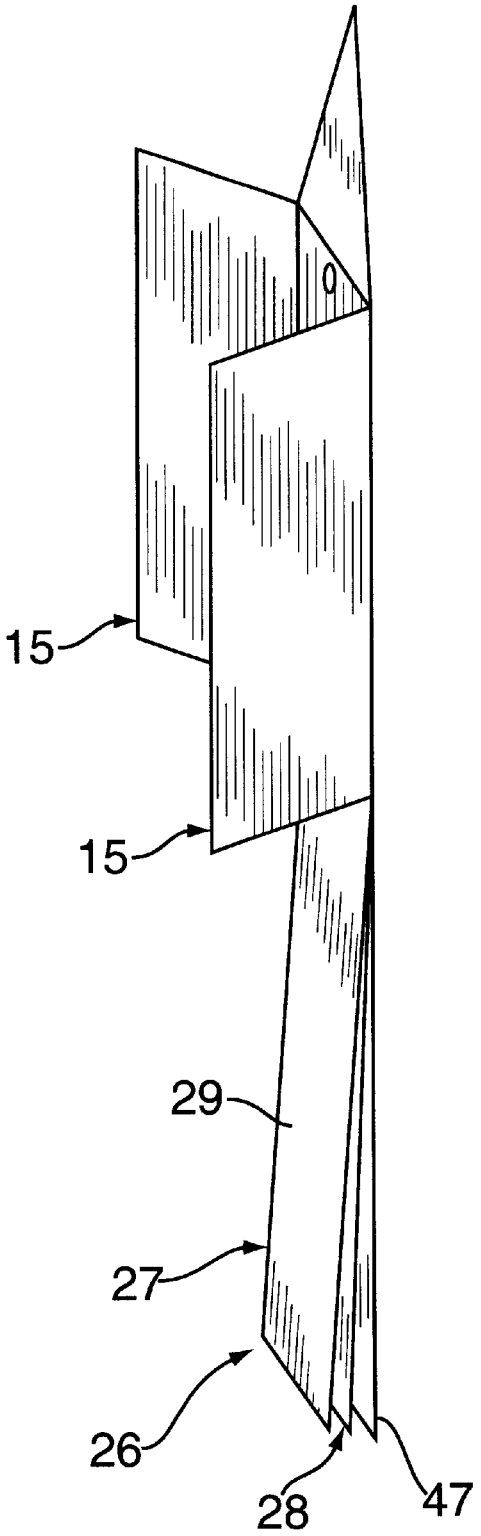
FIG. 6 is a side elevational view of the triptych construction of the invention.

Turning once again to FIG. 3, construction 11 also includes a series of display pages 26 attached to and depending from bottom edge 21 of display panel 13. Display pages 26 consist of a topmost page 27 and succeeding underlying pages 28 (see FIGS. 5 and 6). Each of pages 26 has a front face 29 with some type of image depicted thereon, and a back face 41 also with an image depicted on it (see FIG. 5). Each of pages 26 foldably depends from bottom edge 21 of display panel 13 such that each page may be selectively folded to a flipped over position overlying front face 17 of display panel 13, as best illustrated in FIG. 5.

In the example shown in the figures, front face 29 of each of display pages 26 depicts individual calendar month grids 39. As can be appreciated, as each month passes, the topmost display page is folded up and over (see FIG. 5), revealing the next calendar month. Moreover, as each page 26 is flipped over, back face 41 of that page is now visible, thereby providing a different image to the viewer. Alternatively, the topmost display page may be torn away from the remaining pages as is needed, ensuring that the image depicted on front face 17 of display panel 13 is always visible.

Construction 11, as shown is FIGS. 1 and 3, also includes a flap panel 35 having a front face 37 with an image depicted thereon. This image is complementary to the images depicted on the front faces of display panel 13 and side panels 15.

Construction 11 further includes a back depending panel 47 (see FIG. 6) which is foldably connected to bottom edge 21 of main display panel 13. Back panel 47 is made integrally with the rest of the cardboard blank which defines construction 11 and acts as a back support for display pages 26. As can be appreciated, series of display pages 26 together define a display booklet which is connected to and depends from bottom edge 21 of display panel 13.

Figure 4:
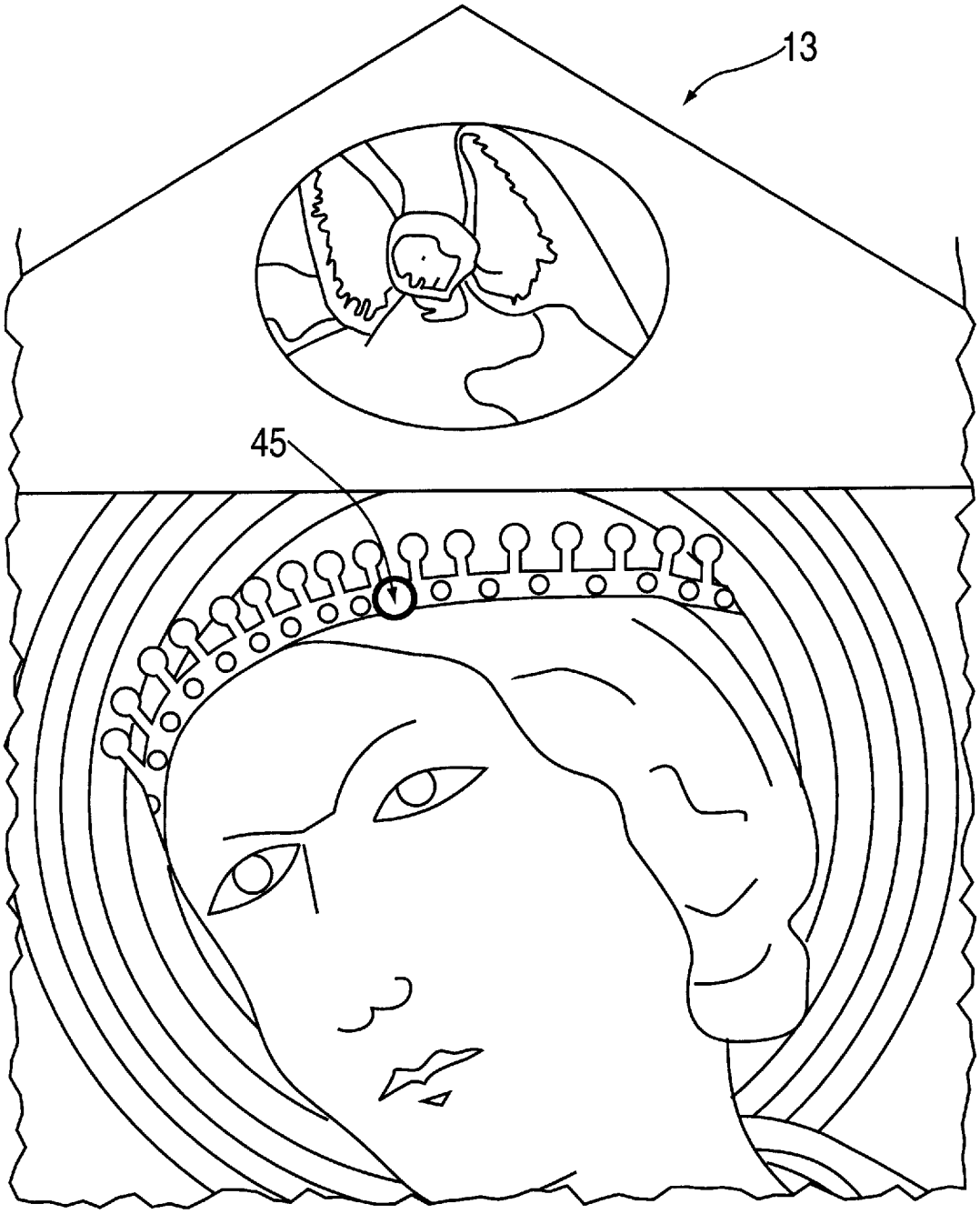
FIG. 4 is an enlarged front elevational view showing the details of the main panel and flap panel, including an opening which is used to attach the construction unit to a wall or other display surface.

In order to hang triptych construction 11 from a wall or other display surface, a hole or opening 45, as depicted in FIG. 4, may be provided in the topmost portion of main display panel 13, through which a nail, screw or other wall support member may be passed. This support member may also be used to secure pages 26 as each is folded over.

In the embodiment shown, when used as a calendar, triptych construction 11 opens to form a cross-like configuration (see FIG. 3). In this form, side display panels 15 display the front faces of the triptych doors with the grid of the each month displayed beneath a central image depicted on front face 17 of main display panel 13. As each month is completed, topmost display page 27 is folded up and is secured to the top of construction 11 using a hook or screw member which penetrates hole 45, thus revealing the succeeding month's central image on the back face of page 27 (see FIG. 5), with the next month's grid displayed below.

Optionally, the display pages could be designed to fold down from top edge 19 of display panel 13, instead of folding up from bottom edge 21, as depicted in the embodiment of the figures.

Construction 11 of the invention may be instead used as a live-action children's book, in which the structure sits on a flat surface, with a series of pages 26 forming the stage "floor." In this form, the doors or side panels 15 open and close to reveal the story and the images as they appear in turn. When used in this way, triptych construction 11 must be made of a paper stock rigid enough to hold its shape and otherwise remain upright.

Other uses of construction 11 include monthly calendars for gardening, food and travel themes, as well as representations of storybook material, such as fairy tales, Shakespearean plays, etc.

By using the triptych design of the invention, a portable calendar or other display is provided in which more pictures or scenes are provided than in prior art designs.

It will thus be seen that the objects set forth above, among those made apparent from the preceding description, are efficiently attained, and, since certain changes may be made in the construction set forth above without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

We claim:

1. A triptych construction comprising:

a main display panel having a front face with an image depicted thereon, said panel being defined by top, bottom and opposite side edges;

a pair of side door panels, each foldably connected to said main panel along said opposite side edges and being foldably displaceable between a first open and outwardly extending position such that said image on said front face of said main panel is fully visible and a second inwardly extending position for substantially covering up said image from view, each of said side door panels extending in said second position from one of said opposite side edges to a common center line; and a series of display pages, including a topmost page and succeeding underlying pages, each page having a front face with a unique image depicted thereon, said pages foldably depending from one of said top and bottom edges of said main display panel.

2. The construction of claim 1, wherein each of said display pages is selectively foldable to a flipped over position overlying said front face of said display panel.

3. The construction of claim 1, wherein each of said display panel and said side door panels is rectangular in shape.

4. The construction of claim 1, wherein said side panels are of a same size.

5. The construction of claim 1, wherein said side panels are sized such that together said side panels completely cover said front face of said main panel when in said second inwardly extending position.

6. The construction of claim 1, wherein at least one of said side panels has a front face with an image depicted thereon.

7. The construction of claim 6, wherein said image depicted on said at least one side panel is complementary to said image on the front face of said main panel.

8. The construction of claim 1, further including a flap panel foldably connected to said main panel along an other of said top and bottom edges thereof.

9. The construction of claim 8, wherein said flap panel has a front face with an image depicted thereon which is complementary to said image depicted on said front face of said main panel.

10. The construction of claim 8, wherein at least one of said main and flap panels includes an element for hanging said construction on a wall.

11. The construction of claim 10, wherein said element comprises an opening through which a hanging member may be passed.

12. The construction of claim 1, wherein each of said display pages also has a back face with an image depicted thereon viewable when said page is flipped over to overlie said front face of said main panel.

13. The construction of claim 12, wherein said image depicted on the back face of each of said display pages is complementary to the image depicted on the front face of a succeeding page in said series of display pages.

14. The construction of claim 1, wherein the image on the front face of each of said display pages is complementary to the image depicted on the front face of said side panels.

15. The construction of claim 1, wherein said series of display pages defines a calendar such that said front face of each of said pages depicts a particular calendar month grid.

16. The construction of claim 1, wherein said display pages detachably depend from said one of said top and bottom edges of said display panel.

17. The construction of claim 1, wherein said series of display pages together define a display booklet connected to and depending from said one of said top and said bottom edges of said main display panel.

18. The construction of claim 1, further including a depending back panel foldably connected to said one of said top and said bottom edges of said display panel and disposed substantially behind said display pages.

19. The construction of claim 1, wherein said main display panel and said side door panels are formed as a unit from a single cardboard blank.

20. A packaged triptych construction comprising:

a main display panel having a front face with an image depicted thereon;

a pair of side door panels foldably connected to said main panel along opposite edges thereof;

a series of display pages together defining a display booklet, said booklet foldably connected to said display panel;

wherein said display booklet is folded over to a position overlying said front face of said display panel;

wherein said side door panels are folded inwardly to overlie said display booklet.

21. The construction of claim 1, wherein said panels are made from a single cardboard blank.

* * * * *